US009668528B1

(12) United States Patent
Laghaie

(10) Patent No.: US 9,668,528 B1
(45) Date of Patent: Jun. 6, 2017

(54) GALLUP CROWN

(76) Inventor: Arya Laghaie, Indianapolis, IN (US)

( * ) Notice: Subject to any disclaimer, the term of this patent is extended or adjusted under 35 U.S.C. 154(b) by 745 days.

(21) Appl. No.: 11/802,110

(22) Filed: May 21, 2007

(51) Int. Cl.
*A41D 20/00* (2006.01)

(52) U.S. Cl.
CPC ..... *A41D 20/00* (2013.01)

(58) Field of Classification Search
CPC ..... A41D 20/00
USPC ..... 2/171, 12, 174, 209; 40/586
See application file for complete search history.

(56) References Cited

U.S. PATENT DOCUMENTS 4,335,471 A * 6/1982 Quigley et al. ..... 2/12
5,926,848 A * 7/1999 Bartholomae ..... 2/171
6,000,063 A * 12/1999 Sullivan ..... 2/209.13
D449,424 S * 10/2001 Dorner et al. ..... D2/869
6,834,453 B1 * 12/2004 Nemeth ..... 40/586
D504,755 S * 5/2005 Milliman, Sr. ..... D2/869
2006/0080759 A1 * 4/2006 Hudson et al. ..... 2/209.13

* cited by examiner

*Primary Examiner* — Katherine Moran
(74) *Attorney, Agent, or Firm* — Winston & Strawn LLP

(57) ABSTRACT

A U-shaped novelty head crown is provided which includes a single head engaging member adapted to be worn on a wearer's head. The novelty head-crown is made of a light weight material that is flexible in nature so that the U-shaped head engaging member may be fitted on the wearer's head without necessity for straps, clasps, or hooks. The method of design and operation of the U-shaped crown is vital to its new result in that the top of the head is to protrude from the center opening of the U-shaped crown so that the product does not cover the top of the head but rather fits around the side of the head.

16 Claims, 3 Drawing Sheets

GALLUP CROWN

CROSS REFERENCES

Not applicable.

BACKGROUND

Field of Invention

This invention relates to a method of novelty headwear, specifically to a method of headwear that is unique in its appearance, manner of operation and subsequent psychological effect.

Discussion of Prior Art

Novelty headwear are popular phenomenon that have achieved various degrees of market success. I assert that novelty headwear should be designed and methodically deployed to invoke psychological effects upon the user and its relation to the symbolic significance of the headwear. In my opinion, aside from invoking feelings of allegiance, commitment or dedication novelty headwear in-truth serves little or no other function for the user. Thus, I assert that at the nucleus novelty headwear is the function of psychological invocation for the user. For the producer, the novelty hat is a profit mechanism. A design method utilized in order to invocate feelings of allegiance and commitment along with maximizing unexploited market profit are issues that novelty hats should address.

The success of past novelty headwear has been limited to some degree with regard to both operational objectives I have established. The novelty headwear of the past through less accurate design, by default have invoked minimal psychological effects upon the user moreover said headwear has failed to maximize this effect as a result of such design and use methods. If an awareness of true objective was present upon production, the producers of such headwear may have deployed a method and design similar to the subject of this patent, however this is not the case. Subsequently, producers have had limited market success relative to the potential market success of a superior design. The design and method of operating a novelty crown rather than hat provides a solution to the shortcomings of past productions.

There are two references of prior art related to this invention. The first of which, U.S. Pat. No. 7,165,272, regards novelty headwear and the method of making the same. There are some disadvantages to the approach deployed by this invention that shall be addressed. The first disadvantage of the aforementioned invention regards the aspect of a head engaging member adapted to be worn on a users head. The invention claims a monopoly on a hat that functions in a typically manner, that is, it sits on the head rather than being configured where it may be utilized by a method more effective for the user and the market.

Rather than covering the top of the head, novelty headwear should be configured by a method of use where it becomes an aspect of the head rather than a cover that sits on top of the head. This assertion is supported by recognition of psychological aspects central to novelty headwear. Novelty headwear that sits on the head and subsequently covers the top of the head is less effective in invoking allegiance, commitment and dedication to the symbolic image presented by the article. Novelty headwear that covers the top of the head suggests an overbearing presence of the symbolism associated with the headwear and thus diminishes the psychological degree of allegiance, commitment and dedication to symbolic apparel which constitutes an issue of past product.

Novelty headwear should become an aspect of the wearer's head rather than covering the head which produces greater results in that the design may be utilized more successfully by invoking feelings of allegiance, dedication and commitment in the absence of overbearing symbolism and thus produces and unexpected result.

When novelty headwear is designed to be utilized by a method that recognizes the importance of invoking allegiance, commitment and dedication, it must be physically designed to be worn in a manner that is less over bearing and more suggestive of individuality inclusive of a shared symbol. Thus, the most market capable design of novelty headwear should include a physical structure that becomes a part of the head, leaving room for the psychological power of implied individuality combined with shared symbolism embodied in the product, rather than a cover for the head which diminishes the invocation of commitment and dedication due to suggested overbearing qualities. Therefore, such a product should be designed and function in a crown-like manner, where the top of the head remains uncovered rather than a head cover sitting on the head as suggested by previous patents, specifically U.S. Pat. No. 7,165,272 (FIG. 1*a*) and U.S. Pat. No. D449,424 (FIG. 1*b*).

The second disadvantage applicable to the said patents regards the description of physical structure. The novelty headwear described in prior art reference U.S. Pat. No. 7,165,272 is a head engaging member with at least one decorative member mounted to the head engaging member. In this description, the constitutive elements of the headwear, thus the head engaging member and the decorative member comprise two separate physical components, which complicates the production of design and simultaneously disadvantage marketability due to depreciation of product physical quality and physical design.

The novelty headwear's head engaging member and its decorative member should consist of one element with no mounting. Thus, the head engaging member and its decorative member including its attachment system are all one component. The design presented by U.S. Pat. No. 7,165,272 and its subsequent separation of constitutive components compromises the designs marketability.

Novelty headwear is a product that serves to invoke feelings of allegiance, commitment and dedication. Thus, when the design lacks the appropriate physical composition necessitated by user demand and maximum market success it fails to solve the problem of user need and unexploited potential revenue, which is the case when the design is compromised by a multitude of constitutive elements which complicate the nature of such therefore making it a less desirable product. A physical-holistic composition of such, rather than a design with a multitude of components, presents an unappreciated advantage in that a simplistic physical design is greater appreciated by the consumer with regard to operation and aesthetic quality and therefore maximizes the product objective and market success.

The design patented in the case of U.S. Pat. No. 7,165,272 includes constitutive elements such as a plastic band deployed to function the head engaging member. Again, this constitutive element of U.S. Pat. No. 7,165,272 complicates the design and unfortunately compromises aesthetic quality thus depreciating usury and market potential. The elements of a novelty hat should be simplistic in utility and design in order to capture the wearer's attention and maximize unexploited market profit.

Another patent that compromises object function and thus maximal market profit is the Horseshoe shaped novelty hat U.S. Pat. No. D449,424 (see FIG. 1*b*). The physical design of the product similarly depreciates the unexploited potential market profit, and unfortunately fails to fully capture the dedication and commitment produced by novelty headwear based on a few reasons.

The physical design of U.S. Pat. No. D449,424 includes two horseshoes morphed into one component. This design depreciates market profit and thus presents a problem in that the two horseshoes morphed into one require the novelty hat to operate in a manner that is less successful in invoking the feelings of commitment and dedication prerequisite and central to the utility of a novelty headwear. The design and operation of said hat in a manner similar to the aforementioned patent is deployed so that it also covers the top of the head thus depreciating the psychological effect which is the central feature of novelty headwear based on its suggestive nature. To the detriment of the product and its producer, market profit is subsequently diminished rather than maximized and the consumer is left without a product that captures the essence of true feeling.

SUMMARY

The product presented in the application is an ornamental novelty crown shaped as a single U-shape with no attachments or clasps. The ornamental crown is one piece constructed of a flexible and simultaneously comfortable material. It is nearly four inches deep and it is fitted to the users head by means of its flexible nature. The crown is designed and worn by a method where the top of the horseshoe is faced upward so that the wearer's head may protrude from the center opening of the horseshoe. This head engaging device, is to be worn so that it functions similar to a crown rather than a hat or top head cover as described in other patents.

OBJECTS AND ADVANTAGES

The Cult-Crown novelty headwear is a design and thus the most obvious advantages are superior aesthetic attributes, however there are also physical advantages to the design that produce new results and capture the utility of novelty headwear like no other design.

The object of the Cult-Crown first and foremost is to produce psychological affects demanded by the product users. The novelty crown accomplishes this by invoking feelings of allegiance, dedication and commitment to the significance of the symbol presented by the product. The method of use and design of the novelty crown is centered around this maxim. Other novelty headwear is designed and function in a manner where they cover the top of the users head and thus are not designed around this maxim. The psychological affects of such designs should not be overlooked and actually have depreciative value with regard to the utility of the novelty hat and maximization of unexploited market potential. Overbearing suggestive elements are undesirable to the consumer and thus depreciative of product value.

Headwear that covers the top of the head has attributes suggestive of full conformity and one-dimensional perspective that is disadvantageous to effective utility and design. In an individualistic culture, such attributes depreciate the quality of the product and lessen the market potential due to what is suggested in these inferior designs. The user of novelty headwear undoubtedly is committed to the symbolic significance of the product this is why she or he chooses to purchase such. However a superior design suggests an element of individuality without suggestively implying over-bearing qualities or strict conformity on the psyche of the product user. Such a novelty hat is more desirable for purchase based on its ability to capture the most desirable suggestive elements. The superior design combines a degree of conformity with room for suggestive individuality which produces a superior psychological effect and makes the product more desirable to the consumer by capturing true feeling. The design of novelty headwear should produce a result such as maximal allegiance, dedication and commitment to the symbolic significance of such a product thus maximizing usury and unexploited market potential.

In an individualistic society products that are less suggestive of conformity while capturing an element of shared commitment are superior in design and market quality because they meet the consumers needs. This is what product users want. They want products that imply a shared essence however still leave room for and imply individuality rather than implied strict authoritative conformity. The Cult-Crown accomplishes this type of superior design and thus by providing the consumer with what is really desired, profit is maximized through unexploited market potential. The novelty crown was designed and is to be used by a method centered around these objectives that serve both the user and producer.

Novelty headwear with a design that fits like a crown, such as the Cult-Crown, is designed in a manner to invoke feelings of allegiance, dedication and commitment to the symbolic significance of the product while leaving room through its suggestive nature for individuality. This assertion is accomplished in that the Cult-Crown allows for the top of the head to protrude through the center of the horseshoe shape without covering the top of the head. Thus, the head engaging member is not a hat but rather a crown in that it does not cover or sit on the head. It becomes an attachment to the head or a part of the individuals head without consuming the entire head or the top of the head in its entirety. This design suggests that the user is dedicated to a symbol that is accepted by multitudes of people, however the design does not constitute or suggest over-conformity to the user allowing for individuality to protrude from the products use. The implications of such a design and method of use should not be underestimated.

The aforementioned prior art references unfortunately fail to combine these two elements effectively and thus the psychological utility of such products is absent or fully diminished and thus the purchasers is left without a product that captures their true feelings. The Cult Crown's physical design addresses this issue because the method deployed for invention, utility, and operation considered these aspects of consumer demand.

Additional advantages of the Cult-Crown include its simplistic design. The Cult-Crown is designed as one piece with no clasps, attachments, bands, or hooks. It is a nearly four-inch deep novelty crown in a U-shape, constructed with one piece of flexible material necessitated for accurate fit. The basic nature of the design makes it easy to produce, transport, and most important adds to its design or aesthetic quality.

In the case of novelty headwear, the Cult-Crown successfully produces results desirable to the consumer in that it is a product that eliminates components unnecessary to a novelty headwear such as clasps, bands, or hooks. Its basic and easy to utilize features are desirable to the consumer for easy transport and function.

Prior art includes numerous constitutive elements which complicate the design, thus compromising production ease and most importantly design or aesthetic quality. These elements of prior art include plastic bands, flexi-bands, and head engaging members separate from decorative members. Efficient production is catalyzed by basic components and produces results for usury.

The elimination of unnecessary design elements is advantageous in several lights. U.S. Pat. No. D449,424 consists of two horseshoes morphed into one piece of headgear. The physical design of the Cult-Crown eliminates the unnecessary element of an additional U-shape, and comprises only one U-shape. The elimination of the unnecessary additional U-shape has several advantages. The first advantage regards the effect of the Cult-Crown with regard to capturing and invoking feelings of dedication and commitment to the symbolic significance of the novelty crown. This is what all novelty headwear should attempt to do. As mentioned previously, the horseshoe novelty hat in U.S. Pat. No. D449,424 is worn in a manner that covers the top of the head and thus fails to accomplish the psychological effects of the Cult-Crown.

The horseshoe novelty hat unfortunately fails in design with regard to its aesthetic quality. The physical appearance of the horseshoe novelty hat has components or attributes that are unnecessary for successfully accomplishing feelings of dedication and commitment to the symbolic significance of the product. Rather than two horseshoes morphed into one piece, the single U-shape is basic in that it contains only the components necessary for aesthetic and psychological effectiveness. The physical difference is a substantial difference in design in that it produces effective design for a new result produced through the method of wearing the crown, usury, and market profit.

The object of the Cult-Crown is to invoke feelings of allegiance, dedication and commitment to the symbolic significance of the product. Furthermore, by successfully invoking feelings of allegiance, dedication and commitment to the symbolic significance of the product, the symbolic feature will maximize and drive profit value of other products associated with the symbol as a result of superior aesthetics and the captivation of what the symbol stands for. This design and method of use gives the wearer what they really want.

DESCRIPTION OF INVENTION

Figure 1:
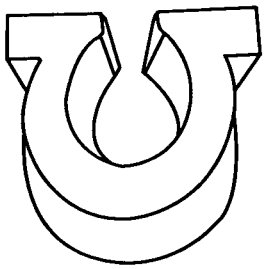
FIG. 1 is an illustration of the Cult-Crown from a rear aerial perspective. The Grip-Fitters labeled in the drawing are the adjustment components of the crown. The user may pull these two sections apart in order to fit the crown around the head. The Flexi-Crown Stabilizer constitutes the internal side walls of the crown which fit around the sides of the wearers head as the users adjusts the size by stretching the crown with the Grip-Fitters. The bottom of the crown will sit just above the wearer's ears and the Flexi-Crown Stabilizers which constitute the entire inner wall of the crown wraps around the wearer's head. The Flexi Crown-Shape Maintenance Mold constitutes the top and bottom layer of the crown and substantiates the shape of the crown. Thus, when the crown is worn, the Grip-Fitters are at or just beyond the wearer's temple and the Flexi-Crown Stabilizer is wrapper around the wearers head with the top of the head protruding from the opening in the middle. The Grip-Fitters constitute the front of the crown when worn appropriately with the head protruding from the opening and thus the perspective in FIG. 1 constitutes a rear aerial perspective of the crown when worn appropriately. Thus, the perspective in figure one shows the top of the crown which faces the sky when worn by the users as is intended.
Figure 2:
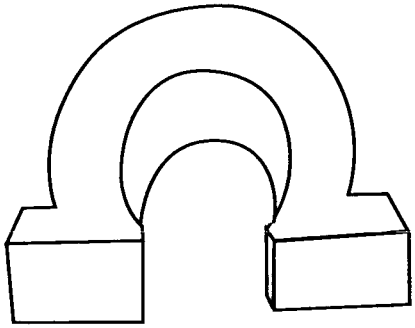
FIG. 2 of the Cult-Crown is a front aerial view of the product. The Grip-Fitters in this illustration are what is first seen by an individual facing a user head-on. Therefore, the Grip-Fitters are if not at, just beyond the temple of the user. The Flexi-Crown Stabilizer is wrapped around the head of the wearer, and the crown sits just above the ears. If the wearer were to face an individual head-on and bend the head slightly forward toward the ground, this is the view that will be visible to the individual facing the wearer. The top of the head must protrude from the opening in the middle of the crown.
Figure 3:
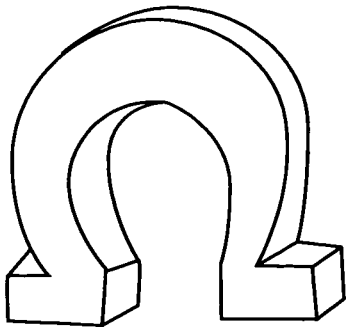
FIG. 3 of the Cult-Crown is a perspective of the crown which demonstrates how the crown should not be worn, as suggested by U.S. Pat. No. D449,424. This is significant in that the manner of wearing the crown is most significant to its effective object. If the crown in worn so that the Grip-Fitters are closest to the ground and the bottom of the U-shape faces upward (the curve of the U), the crown no longer constitutes and crown but rather a hat, thus defeating the unexpected result, purpose, and quality of the design.
Figure 4:
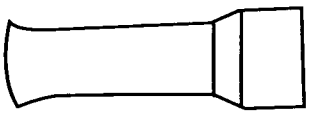
FIG. 4 of the Cult-Crown is a profile view of the product. This is the view an individual non-wearer will have of the crown when worn by the wearer appropriately. The Grip-Fitters will protrude outward from the temple of the wearer while the crown stabilizer wraps around the side of the wearers head just above the ear with the top of the skull protruding beyond the four inch thick product.
Figure 5:
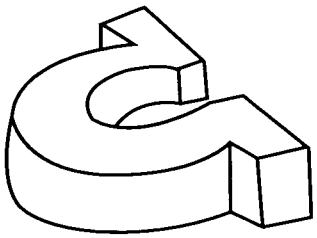
FIG. 5 is a rear-right side aerial view of the Cult-Crown. The back of the product is most apparent in this illustration. The curvature is a portion of the product which wraps around the wearers head where the Grip-Fitter will protrude outward from the wearers temple or just beyond when worn appropriately. The center opening of the Cult-Crown is where the top of the wears head protrudes up and out and gives the novelty crown its new effective result.

Although the Cult-Crown in whole has elements that serve different functions, they all constitute one piece that is only functional as a whole. The static physical structure of the Cult-Crown is a U-shaped structure with depth sufficient to remain stable on the wearers head. The outer wall of the U-shaped structure is one aspect of the whole component. The top of the U-shaped structure is still part of the outer wall of the U-shaped structure which is necessary to forming the physical shape of the product. The inner wall of the U-shaped structure is the most significant to the physical design of the product. The inner opening is necessitated by appropriate and effective use in that that opening provides the means for the structure to be deployed in a manner conducive to the object of the article.

As a whole made of one piece, the product is a basic U-shaped crown with a middle opening in the front where two blocks (Grip-Fitters) protrude outward where the opening or absent structure is present in the product. From each of these two blocks are two parallel channels equivocal in length with appropriate curvature so that they meet at the back of the product by means of a curved channel.

In whole the U-shaped product should be stamped out of a flexible material as one whole piece with depth and flexibility adequate for stability and size.

Operation of Invention:

The operation of the Cult-Crown is embodied in the single piece product as a whole. There are however elements of the invention that serve functions that make the Cult-Crown operate effectively as a whole. The first of these is said Grip-Fitters. The Grip-Fitters constitute the blocks that protrude outward, one to the right, the other to the left, from the parallel channels of the crown. The said Grip-Fitters operate in a manner that allows the user to stretch and subsequently size the Flexi-Crown Stabilizer and the Flexi Crown-Shape Maintenance-Mold to the appropriate size of the wearers head.

The Flexi-Crown Stabilizer is the portion of the Cult-Crown that wraps around the side of the wearers head above the ears and operates to stabilize the Crown in the appropriate position. It constitutes the inner sidewall of the product. This portion of the Crown operates to stabilize through its flexible nature and holds the crown in place on the wearers head.

The Flexi Crown-Shape Maintenance-Mold operates to maintain the shape of the crown. Based on the flexible nature of the device, the Flexi Crown-Shape Maintenance-Mold operates to maintain the overall shape of the product during and after use. It is vital to the design maintenance of the product and functions as such.

CONCLUSION

The Cult-Crown is an ornamental design of a novel crown that produces new results and is unlike any other novelty headwear. The designs object and advantage is based on its ability to capture the invocation of dedication and commitment to the symbolic significance of the device making it superior in market potential with regard to unexploited market potential. The basic design-shape being a flexible U-shaped crown with aesthetic superiority and easy function, which gives it greater advantage over other attempts to produce such an effect. The object of producing psychological effects of dedication and commitment should be the object and purpose of all novelty headwear as is the case with the method deployed by inventing the Cult-Crown and operating the product.

Although the description above contains many specificities, these should not be construed as limiting the scope of the invention but rather as presenting some of the presently preferred embodiments of this invention. Thus the scope of the invention should be determined by the appended claims and their legal equivalents, rather than by the examples given.

I claim:

1. A novelty crown to be worn on a wearer's head comprising:

a single u-shaped member with no mounting that does not include two u-shaped members morphed into one piece and adapted to be worn as a crown, the member comprising:

an inner curved wall to hold the crown in place on the wearer's head; and two blocks disposed opposite each other and protruding outwardly from each leg of the u-shaped member;

wherein the u-shaped member and two blocks are made of flexible material and allow the two blocks to be pulled apart so that an opening may be enlarged; and the u-shaped member and the two blocks are of substantially uniform thickness, wherein, as recited above, the crown has only one u-shape as defined by the recited single u-shaped member, wherein the crown is adapted to be placed on the wearer's head such that a top of the wearer's head protrudes through the u-shaped member and is exposed, and wherein the u-shaped member including the two blocks is a single-piece comprising a rectangular cross-section which is at a right angle to a longest axis of the crown.

2. The novelty crown of claim 1 wherein the single u-shaped member comprises an outer curved wall opposite to the inner curved wall, wherein the outer curved wall is unobstructed at one end of the single u-shaped member, which is facing opposite a u-shape of the single u-shaped member.

3. The novelty crown of claim 1 wherein the novelty crown has a physical shape consisting of the single u-shaped member, the inner curved wall, the two blocks, and an outer curved wall including unobstructed curved surface opposite to the u-shape.

4. A novelty crown to be worn on a wearer's head consisting of:

a single member with no mounting and adapted to be worn as a crown, the member having a single u-shape and two blocks extending outwardly from first and second ends of the single u-shape, and further wherein the member consisting of an inner curved wall defining an opening, the inner curved wall being adapted to fit around the wearer's head above the wearer's ears such that a top of the wearer's head protrudes through the opening and is exposed; and wherein the u-shape and two blocks allow the two blocks to be pulled apart so that a dimension of the opening may be enlarged;

wherein the member is a single-piece having a rectangular cross-section which is at a right angle to a longest axis of the crown; and wherein the single member having an outer curved wall following a curve in a same direction as the inner curved wall and the outer curve wall having no obstruction until reaching the two blocks.

5. The novelty crown of claim 4, wherein the u-shape and two blocks are integrally formed in a single-piece construction made of a flexible material.

6. The novelty crown of claim 5, wherein the inner curved wall is dimensioned such that the u-shape fits securely around the wearer's head.

7. The novelty crown of claim 5 with the single-piece construction having a substantially uniform thickness.

8. The novelty crown of claim 5 with the single-piece construction having a substantially uniform thickness four inches deep.

9. A method to wear a crown on a wearer's head comprising:

forming with flexible material a single piece horseshoe shaped member with no mounting, wherein the member comprising two blocks disposed opposite each other and extending outwardly from a first and a second end of the member, and further wherein the horseshoe shaped member is adapted to be worn as a crown by a user such that a top of the wearer's head protrudes through the member and is exposed, wherein the single piece horseshoe shaped member, that is formed, does not include a second u-shaped member morphed with the single piece horseshoe member into one piece whereby creating only one horseshoe shaped member in the crown, and wherein the single piece horseshoe shaped member comprises a rectangular cross-section which is at a right angle to a longest axis of the crown;

pulling apart the two blocks to enlarge the opening; and wearing the member crown such that a top of the wearer's head protrudes through the member and is exposed, and further wherein the blocks fit and rest at or beyond a wearer's temple leaving an opening at the forehead of the wearer, wherein an inner curved wall is dimensioned such that the member fits securely around the wearer's head when worn as a crown.

10. The method of claim 9, wherein the member and the two blocks are of substantially uniform thickness.

11. The method of claim 9, wherein the member and the two blocks are four inches deep.

12. The method of claim 9 wherein the forming comprising stamping a member comprising the recited a single piece horseshoe shaped member.

13. An article of headwear comprising:

a crown adapted to fit a wearer's head and adapted to expose the top of the wearer's head, the crown consisting essentially of:

a single piece member made of flexible material with no mounting that does not include two u-shaped members morphed into one piece and adapted to be worn as a crown, the member consisting essentially of a single u-shape having an inner curved wall defining the opening, the inner curved wall being adapted to fit around the wearer's head such that the top of the wearer's head protrudes through the opening, and the member having two blocks disposed opposite each other and extending outwardly from the u-shaped member, and wherein the single piece member has an unobstructed outer surface at one end facing away from the u-shape that is curved in a same direction as the inner curved wall;

wherein the member allows the two blocks to be pulled apart so that a dimension of the opening may be enlarged;

wherein the member is a single-piece comprising a rectangular cross-section which is at a right angle to a longest axis of the crown; and wherein as recited above, the headwear has only one u-shape.

14. The article of claim 13, wherein the member is integrally formed in a single-piece construction made of flexible material.

15. The article of claim 13, wherein the two blocks are positioned on the member such that the novelty crown is worn around the wearer's head and the two blocks extend outwardly from the wearer's temples.

16. The article of claim 13 with the single-piece having a substantially uniform thickness.

* * * * *